United States Patent [19]

Bodenmann et al.

[11] 4,250,997

[45] Feb. 17, 1981

[54] LOCKING CAPSULE FILLED WITH VISCOUS MATERIAL

[75] Inventors: Hans U. Bodenmann, Muenchenstein, Switzerland; Louis P. Van Herle, Zandhoven, Belgium; Luc Y. Michel, Fegersheim-Ohnheim, France; Winand H. Martens, Belsele, Belgium; Heinrich Pins, Eberbach, Fed. Rep. of Germany

[73] Assignee: Capsugel AG Corporation, Basel, Switzerland

[21] Appl. No.: 39,030

[22] Filed: May 14, 1979

Related U.S. Application Data

[63] Continuation-in-part of Ser. No. 890,753, Mar. 27, 1978, abandoned.

[30] Foreign Application Priority Data

Mar. 29, 1977 [DE] Fed. Rep. of Germany ..... 2713873
Mar. 29, 1977 [DE] Fed. Rep. of Germany ... 7709877[U]

[51] Int. Cl.[3] ..... B65D 53/06; B65D 85/00

[52] U.S. Cl. ..... 206/528; 215/233; 220/364; 206/525

[58] Field of Search ..... 206/528, 525, 534; 220/306, 364; 215/233

[56] References Cited

U.S. PATENT DOCUMENTS

| | | | |
|---|---|---|---|
| 1,834,085 | 12/1931 | Bloom | 215/233 |
| 1,836,220 | 12/1931 | Bloom | 215/233 |
| 3,149,188 | 9/1964 | Schmitt | 206/525 |
| 3,399,803 | 9/1968 | Oglevee et al. | 220/306 |

*Primary Examiner*—William T. Dixson, Jr.
*Attorney, Agent, or Firm*—Louis S. Gillow; Stephen Raines; Stephen I. Miller

[57] ABSTRACT

A sealed capsule, for example a locking capsule, filled with liquid or other viscous material, in particular a liquid pharmaceutical preparation; and a method for the production of a sealed capsule.

20 Claims, 9 Drawing Figures

LOCKING CAPSULE FILLED WITH VISCOUS MATERIAL

This is a continuation-in-part of U.S. Ser. No. 890,753, filed Mar. 27, 1978, now abandoned.

SUMMARY

The present invention relates to a sealed capsule, for example of locking capsule, filled with liquid or other viscous material, in particular a pharmaceutical preparation and having a body part and a cap telescoped thereone.

BACKGROUND OF THE INVENTION

Two basically different types of capsules for pharmaceutical preparations are commonly used: a "hard-shell" capsule and a "soft-shell" capsule. Conventional hardshell capsules are formed mostly of gelatine, have a body part (lower portion) and a cap (upper portion) telescopically engaging the body part, and contain pharmaceutical preparations in solid form, such as powder or pellets. Conventional soft-shell capsules are formed of gelatin and plasticizers, and usually contain pharmaceutical preparations in liquid form, such as suspensions, pastes and oils. The two types of capsules, which are intended predominantly for oral administration, are filled in different manners.

Thus, the hard-shell capsule can be filled by the manufacturer of the pharmaceutical preparation himself, for instance by filling the body part with the solid pharmaceutical preparation, then telescopically fitting a cap onto the body part, with any trapped air being vented through a gap between the body and cap parts, then if required, providing the capsule with a band sealling the free end of the cap with respect to the outer wall of the body part.

In contrast, the filling of conventional soft-shell capsules with liquid pharmaceutical preparations is relatively complex as the soft-shell capsules are formed only at the time of their being filled, from two joined halves enclosing between them the liquid pharmaceutical preparation. These operations require a specific technique and are usually not performed by the manufacturer of the pharmaceutical preparation himself, which causes considerable disadvantages, also in view of the high demands made on quality and safety that have to be observed in the manufacture of finished medicament capsules.

Until now, so far as we are aware, there has been no simple process for filling medicament capsules with liquid pharmaceutical preparations at the site of manufacture of the pharmaceutical preparation assuming that this site is different from the place of manufacture of the capsule parts. In the case of soft-shell capsules, this cannot be realized in view of the complex technique. In the case of hard-shell capsules, sealing problems are encountered because the liquid pharmaceutical preparation penetrates into the space between the external surface of the body part and the internal surface of the cap and it is necessary to protect against such leaking by providing a band around the capsule. In practice, there is need not only for capsules filled with liquid pharmaceutical preparations, but quite generally for capsules filled with any liquid or viscous materials, for example, liquid or pasty materials. Such materials can be, for example, stain-removing agents, solvents, volatile oils, liquid spices, silicone oils or chicken fat. Hard-shell capsules are particularly advantageously used for containing materials that must be carefully stored (e.g. air-tight), must remain ready for use, and are required in small amounts, i.e. in portions. The materials may, for example, become thinly liquid when they are heated and thickly liquid or even pasty when they are cooled.

DETAILED DESCRIPTION OF THE INVENTION

Figure 1E:
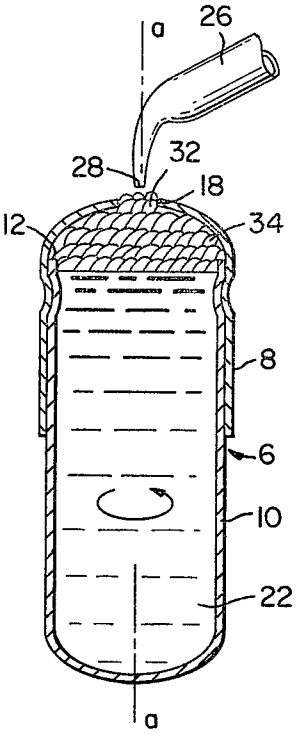

According to the present invention there is provided a sealed capsule containing a liquid or other viscous material, the capsule comprising a body part having an open end region or ridge and a closed end region and a cap having an open end region and a closed end region and being telescopically mounted on the body part, wherein the body part is filled with the liquid or other viscous material and the ridge or open end region of the body part received in the cap is sealed to the adjacent area of the internal surface of the cap with a sealing composition which is inert with respect to and insoluble in the liquid or other viscous material.

The sealing composition may be a pasty, solidifiable sealing composition inert with respect to and insoluble in the liquid or other viscous material. The sealed capsule according to the present invention, being sealed from inside, should be reliably tight as the sealing composition enters into a positive bond with the ridge or open end of the body part. Besides, in practice, the ridge of the body part is located in most of the capsules in that area of the cap where the cylindrical side wall of the cap changes over to the curved closed end, an area, in other words, displaying a high mechanical stability so that the sealing composition remains free from mechanical stresses to a large extent.

There are various, simple procedures for applying the sealing composition, as it will be explained in the following. The sealing composition, and the liquid or other viscous material as well, can be introduced into the joined capsule through an aperture, which aperture can be closed with sealing composition after the capsule has been filled or can be welded by locally heating the joined capsule.

Advantageously, the entire interior of the closed end region of the cap including the area of the ridge or open end region of the body part is filled with sealling composition. In this manner, a good mechanical stabilization of the filled capsule is obtained; additionally there is the advantage that the sealing composition sealing the area between the free end of the body part and the internal surface of the cap can enter into a bond with the material of the capsule and rest against the internal surface of the cap over a large area, which can improve the sealing of the filled capsule. Also, with this arrangement the filled capsule is free from air pockets, which makes it possible to store for a long period materials that would perish upon contact with air.

Conveniently, as indicated above, in a preferred embodiment of the filled capsule an aperture is formed in the closed end region of the cap.

Starting from a pre-fabricated, complete, but empty hard-shell capsule, a filled capsule may be produced in the following way. The prefabricated capsule is first provided with an aperture at that end belonging to the cap. Then, the capsule is filled with for example, pasty material through the aperture, in its upright position, up to a level below the ridge or open end of its body part. The open end of the body part is then sealed to the internal surface of the cap by introducing the sealing composition above the fill, so that the sealing composition forms an uninterrupted layer across the entire cross section above the fill, which layer completely encloses the pasty material and prevents it from leaking through the aperture in the cap. This filling and sealing of the capsule does not require any complex technology, and thus the use of liquid or other viscous materials, which may be thinly liquid or even pasty is possible at the site of the manufacturer of the respective material itself.

In a preferred embodiment, a plug of sealing composition is applied to the aperture of the capsule and extends over the aperture. The plug provides for a positive bond between the sealing composition and the cap and can thus ensure that the space above the pharmaceutical preparation or other fill remains filled with sealing composition in the event of any shrinkage caused by solidification of the sealing composition, and that no cracks are formed that might lead to leakage.

An alternative embodiment of the filled capsule is that in whih an aperture is provided in the closed end of the body part which is sealed with sealing composition. With this embodiment, sealing composition can first be introduced through the aperture, while the capsule is in the upright positon with the body part pointing upwardly, to a level above the ridge or open end of the body part, after which the liquid or other viscous material is introduced through the same aperture to a level below the aperture, whereupon the aperture is then sealed with sealing composition. This filling procedure is particularly simple in that it is not necessary to form above the liquid or other viscous material a coherent layer of sealing composition covering the cross section of the locking capsule. The sealing material introduced first into the cap, which could as an alternative be introduced through an aperture in the bottom of the cap, fills the bottom region of the cap to a level above the open end of the body part and thus seals the capsule in this area. The sealling composition applied additionally after the introduction of the liquid or other viscous materialonly has to seal the aperture in the body part so that there is no danger that the aperture will not be totally closed during introduction of the sealing composition owing to the initially tough and viscous consistency of the sealing composition.

A development of the last-mentioned embodiment of the locking capsule is that in which a further cap is telescoped on the body part of the capsule filled with liquid or other viscous material, and sealling composition is contained in the area of the aperture between the closed end of the further cap and the body part. This further cap stabilizes the capsule additionally, and consequently makes the seal even more secure.

In a preferred development of the capsule provided with a further cap, the area between the further cap and the first-mentioned cap closing the open end of the body part is sealed with a band. When for instance both caps are made of a material resistant to gastric juice there is obtained a delayed-release capsule. A still further preferred embodiment of the capsule provided with a further cap, is that in which an additional cap is telescoped on the first-mentioned cap closing the open end of the body part, which additional cap is sealed with respect to the further cap by means of a band. In this manner a capsule can be provided in which it is unimportant whether the further cap or the additional cap are exactly true to dimensions, and in which these caps are not in direct contact with the liquid or other viscous material and can consequently be made of another material which solely depends on the prevailing conditions.

Another aspect of the present invention provides a method for the production of a sealed capsule formed of a body part having a ridge or open end region and a closed end region and a cap which has an open end region and a closed end region and which is telescopically fitted on the body part, the body part being filled with a liquid or other viscous material, which method comprises filling the body part of the closed capsule with the liquid or other viscous material through an aperture in the capsule, and sealing the ridge or open end region of the body part received in the cap with respect to the adjacent area of the internal surface of the cap from inside with a pasty, solidifiable sealing composition which is inert with respect to and insoluble in the liquid or other viscous material.

This method according to the present invention is simple to put into effect, and provides for the reliable sealing of capsules filled with liquid or other viscous material, since these sealed capsules are sealed from the inside with the sealing composition which positively engages the ridge or open end region of the body part. This ridge of the body part is preferably located in that area of the cap where the cylindrical side wall of the cap changes over to the curved closed end of the cap, namely an area which is mechanically very firm and undergoes therefore little deformation which in turn ensures that the sealing composition remains free from mechanical stresses to a large extent.

In accordance with a preferred embodiment of the method of the present invention, the capsule is aligned with its axis approximately vertical with the cap uppermost, and the liquid or other viscous material is introduced through an aperture in the closed end of the cap to a level below the ridge of the body part, after which through the aperture the space above the liquid or other viscous material is filled with the sealing composition. In this embodiment, the areas of the internal surface of the capsule which are in contact with the sealing composition do not contact the liquid or other viscous material. This ensures that the sealing composition enters reliably into a bond with the ridge or open end of the body part and the internal surface of the cap. Another advantage acheived with this embodiment is that it is possible to keep the amount of introduced liquid or other viscous material uninfluenced by variations of the capsule volume caused by irregularities in capsule dimensions. Irregularities in the capsules can be compensated by varying the amount of sealing composition used.

Preferably, the aperture is formed on the axis of the capsule and the capsule is slowly rotated about its axis during introduction of the sealing composition. In this manner, it is particularly simple to introduce the pasty sealing composition such that it forms a continuous layer above the liquid or other viscous material, which layer closes the body part of the capsule in the upward direction and seals it with respect to the cap.

In an advantageous embodiment of the last-named arrangement the sealing composition is introduced by extruding the composition from an orifice, and the orifice is moved, during extrusion, from an area adjacent the ridge or free and of the body part, after at least one revolution of the capsule, first radially inwardly towards the axis of the capsule and then upwardly out of the aperture.

In accordance with another preferred embodiment of the method of the present invention, a plug is applied in the region of the aperture, extending thereover and consisting of sealing composition. This plug provides for a positive bond between the sealing composition and the cap and can ensure that during any shrinkage occurring, possibly during solidification of the sealing composition, no cavities are formed, the space above the pharmaceutical preparation remains filled with the sealing composition, and no cracks are formed that might cause leakage.

In the last-mentioned embodiment of the method of the present invention, the liquid or other viscous material is introduced prior to the sealing composition. An alternative embodiment of the method according to the invention is that the sealing composition is introduced prior to the liquid or other viscous material. In this alternative embodiment there is no need to see to it, when introducing the liquid or other viscous material, that material does not come into contact with the ridge or open end of the body part and the adjacent internal surface of the cap. Such a contact area to be sealed with the liquid or other viscous material would lead to limitations as regards the usable sealing compositions that have to enter into a regular bond with the material of the capsule. Moreover, some of the sealing compositions enter reliably into a bond with the material of the capsule only when it has not been wetted previously with the liquid or other viscous material.

In the aforementioned alternative embodiment, the capsule is advantageously aligned with its axis vertical and body part uppermost and is filled to above the ridge or open end of the body part with sealing composition; then the joined capsule through an aperture in the closed end of the body part is filled with the liquid or other viscous material to a point below the aperture, and the aperture is sealed thereafter. The sealing composition can be introduced into the capsule either from above, or from below through an aperture in the cap, which aperture, upon withdrawal of a needle with which the sealing composition is introduced, is automatically sealed.

It is also convenient to introduce the sealing composition through the aperture in the closed end of the body part. These last-named embodiments are particularly simple in that it is not necessary with them to form above the liquid or other viscous material a coherent layer of sealing composition covering the cross section of the capsule. The sealing composition introduced first into the interior of the cap fills the bottom of the cap up to above the ridge or free end of the body part and thus seals the capsule in this area. After the introduction of the liquid or other viscous material, the additionally applied sealing composition only has to seal the aperture formed in the body part; there is no danger owing to the initially glutinous, viscous consistency of the sealing compositition that the aperture is not totally closed.

It is of advantage to compress the capsule radially after introducing the liquid or other viscous material so that material rises to a level directly below the aperture, then to apply the sealing composition drop-wise over the aperture to cover the aperture, and directly thereafter to release the capsule of the compressive force. The last drop is drawn slightly into the capsule so that the sealing composition penetrates into the upper end of the cap and positively engages the ridge defining the aperture thereby ensuring a reliable seal.

In another embodiment of the method of the present inventions, the aperture is sealed by fitting a further cap on the body part of the capsule filled with the liquid or other viscous material; this fitting is done after sealing composition has been provided at the inner side of the closed end of the further cap, or at the outer side of the body part in the area of the aperture The sealing composition can be smeared across the area before the further cap is fitted so that a large-area seal is provided. A capsule produced in this manner is particularly stable mechanically, while the sealing composition itself is to a large extend protected from mechanical deformation.

A capsule produced according to the last-mentioned embodiment can be provided on its external surface between the two caps with a band whereby the capsule can be made resistant to gastric juice provided the two caps are made of a material resistant to gastric juice, to obtain a delayed release preparation when a liquid pharmaceutical preparation is present within the capsule. It is also possible to fit an additional cap over the original cap, whereby a capsule resistant to gastric juice is also obtained provided the further cap and the additional cap are resistant to gastric juice; the further cap and the additional cap can be made from a material other than that of the body part and the inner cap, and there is no need for dimensional accuracy for the further and additional caps since these caps can be sealed by means of a band.

Generally, the sealing composition is advantageously introduced at an increased temperature depending on the viscosity desired. Immediately after introducing the sealing composition into the capsule, the temperature of the composition falls to the temperature of the capsule, which is the ambient temperature, and solidifies almost at once.

When the material of the capsule is gelatine, the sealing composition is preferably gelatine as well. This gelatin introduced in its pasty state, by heating it, for instance to the temperature required for the desired viscosity, enters into intimate bond with the material of the capsule which has not come into contact with the liquid or other viscous material in the areas to be sealed, prior to sealing, so that the finished capsule should be reliably sealed and mechanically stable.

As pasty material for sealing may be used, for example, also dimethyl cellulose, starch, shellac, a solution of cationic polyacrylate in isopropyl alcohol and acetone, as well as other lacquers which are common for banding capsules, or for the production of a cover for capsules resistant to gastric juice. Usable are all materials that enter into an intimate bond with the material of the capsule, do not dissolve in the liquid or other viscous material and show minor shrinkage upon setting or solidifying. When the liquid or other viscous material is a pharmaceutical preparation, the sealing composition must be edible and non-toxic.

When materials are used that undergo considerable shrinkage upon solidification, it is advantageous to allow the filled capsule to dry or to set in an atmosphere of inert gas such that no oxygen is drawn into the interior of the locking capsule upon reduction of the volume, as oxygen can be detrimental for some types of liquid pharmaceutical preparations. When using gelatine as sealing composition, the formation of bubbles was observed sometimes at the interior of the capsule, caused by mostly harmless water vapor formed upon solidification of the gelatine. When using gelatin, it is advantageous to work with a mixture of solid gelatine particles and aqueous gelatine since such a mixture displays little shrinkage.

The present invention allows a simple manufacture of capsules, e.g., locking capsules, filled with for instance a liquid pharmaceutical preparation, which manufacture can be continuous and fast. The capsule filled with liquid or other viscous material and sealing composition can be further processed immediately after having been filled since the capsule has a sufficient stability on account of its own rigidity even if the sealing composition has not solidified completely. Suitable for use in the present invention are all conventional, prefabricated, hard-shell locking and nonlocking capsules. The finished capsules can have different appearances depending on the different areas—cap, body part, aperture covered with sealing composition, interior space of the capsule filled with sealing composition, etc.—when they are differently colored and/or show a different transparency of the materials, so that they can be widely varied in their esthetic appearances. It is self-understood that the capsules can be provided with an aperture already while they are manufactured, or while they are filled.

For the manufacture of the capsules according to the invention, one can use a conventional high speed continuously operating filling machine. The machine can be employed after having been adjusted slightly, as it is used for filling capsules with pulverulent pharmaceutical preparations (e.g. an apparatus in accordance with DT-OS No. 2 048 948). The machine may omit the conventional station where the supplied, joined capsule is separated into its body part and cap; instead the station where the cap is fitted again on the body part (once filled with a pulverulent pharmaceutical preparation) can have a mandrel with which the aperture in the capsule is formed. This station is then followed by filling stations in which the filling of the capsule with pharmaceutical preparations and the sealing composition is effected. The movement of the orifice through which the sealing composition is extruded and applied, can be effected for example in that a needle at the end of which the orifice is formed is retained by a pivotable mounting moving alongside a cam surface.

For a better understanding of the invention and by way of example to show how the same may be practiced, reference will now be made to the accompanying drawings in which:

FIGS. 1*a* to 1*e* are vertical cross sections through a capsule at various stages of filling and sealing; and FIGS. 2 to 5 are vertical cross sections through each of four different modified embodiments of filled sealed capsules according to the convention.

Figure 1D:
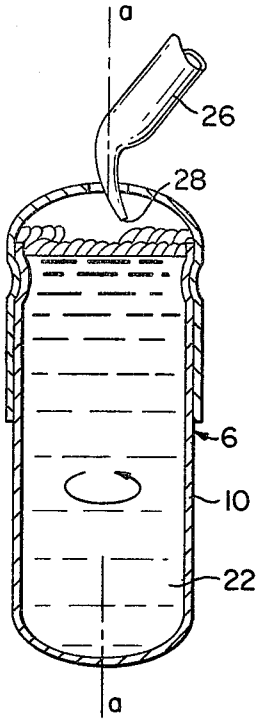
Figure 1C:
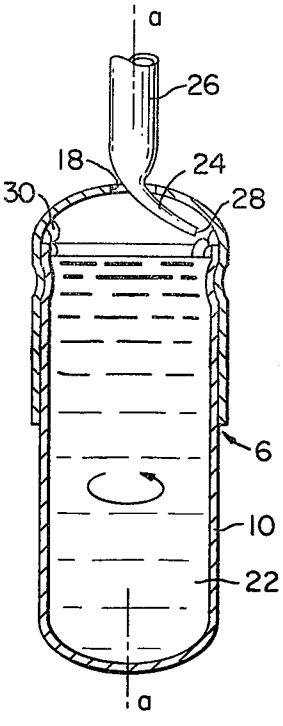
Figure 1B:
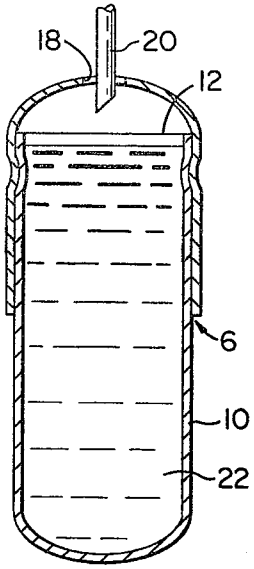
Figure 1A:
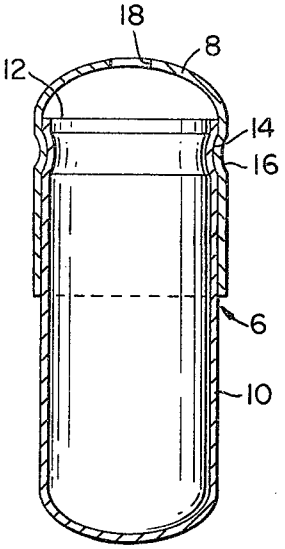

Referring to FIG. 1*a*, there is shown a locking capsule 6 having a cap 8 and a body part 10, both of these parts having an open end and a closed end region. The body part 10 is provided in the proximity of its ridge or open end 12 with a groove 14, which is engaged by a corresponding groove 16 of the cap 8 so that the cap 8 and the body part 10 are rigidly mechanically joined. In the closed end of the cap 8 an aperture 18 is formed, by means of drilling, for instance.

FIG. 1*b* shows a distal end region of a needle 20 being passed clearly through the aperture 18. Through this needle 20 a liquid pharmaceutical preparation 22 is introduced into the body part 10, with the capsule 6 in a vertical position, to a level about 1 mm below the ridge or upper end 12 of the body part 10. Care has to be taken, in this connection, that the liquid pharmaceutical preparation 22 does not contact either the rim of the aperture 18, the ridge or open end 12 of the body part 10, or the internal surface of the cap 8 in the area of the ridge or free end 12 of the body part 10.

The needle 20 is withdrawn from the aperture 18 after filling the majority of the body part 10 with liquid pharmaceutical preparation 22, and then in accordance with FIG. 1*c*, there is inserted through the aperture 18 a needle 26 having a bent tip 24 in a manner such that its orifice 28 is spaced by only a small distance from the ridge 12 of the body part 10. The capsule 6 is then slowly rotated about its own axis a—a and from the orifice 28 of the needle 26 a highly viscous, heated gelatin is extruded as a sealing composition which in the form of a bead 30 is positioned in the area of the ridge 12 of the body part 10 and the adjacent internal surface of the side wall of the cap 8 and penetrates in part into any slight gap between the cap 8 and the body part 10. During this process, the gelatine cools at once and solidifies rapidly so that the bead 30—which initially partly dissolves the adjacent areas of the capsule 6 consisting likewise of gelatine—enters into a bond with the material of the capsule which bond solidifies rapidly and provides a seal of the cap 8 with respect to the body part 10.

Then as shown in FIG. 1*d*, the needle 26 is rotated about a transverse axis such that, while the capsule 6 is rotated about is axis a—a, the orifice 28 of the needle 26 moves from the area of the ridge 12 of the body part 10 obliquely upwardly in the direction to axis a—a. The pasty gelatine which is continuously extruded from orifice 28 is placed spirally, ring by ring, on the bead 30 and forms an uninterrupted layer filling the cross section of the cap 8 directly above the pharmaceutical preparation 22. In this connection it has to be observed that the layer is not spaced above the level of the pharmaceutical preparation 22, which spacing could cause air to be enclosed between the layer and the pharmaceutical preparation 22; nor is the layer immersed in the pharmaceutical preparation, which could cause the latter to be enclosed above the layer thus leading to leakage during further filling of the cap 8 with sealing composition, as described hereinafter.

Subsequently, in accordance with FIG. 1*e*, the needle 26 is moved while the capsule 6 is still rotated about its axis a—a such that the orifice 28 moves first upwardly inside the cap 8 and then out through the aperture 18. The entire space within the cap 8 is thus filled with gelatine and the air expelled from the cap 8 is vented through the aperture 18. The extrusion of gelatine from the orifice 28 is terminated as soon as the orifice 28 has been removed from the cap 8 and a plug 32 of gelatine formed in and over the aperture 16. The now finished capsule is completely filled with gelatine 34 above the pharmaceutical preparation 22 which ensures that the gelatin 34 enters into a rigid bond directly with the material of the cap 8 (being likewise of gelatine) and of the ridge 12 of the body part 10 which in turn reliably seals the capsule 6 and, as soon as the gelatine 34 has solidified, provides in addition for a mechanical stabilization of the capsule.

Figure 2:
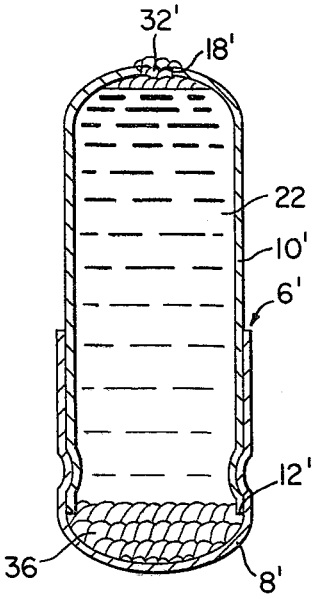

FIG. 2 shows an embodiment of a sealed capsule 6' filled with a liquid pharmaceutical preparation 22 which capsule has been filled in a manner somewhat different from that described above in relation to FIG. 1. The capsule 6' has its body part 10' uppermost and has at the closed end of its body part 10' an aperture 18'; the capsule 6' is first filled through the aperture 18' with sufficient gelatine to fill the cap 8' with a continuous gelatine body 36 to a level above the ridge 12' of the body part 10', this gelatine body sealing the cap 8' with respect to the body part 10'. Then the pharmaceutical preparation 22 is introduced through the aperture 18' to a level just below the aperture 18'. It is observed that the rims of the aperture 18' remain free of pharmaceutical preparation. The aperture 18' is thereafter closed with gelatine 32'. This closing is advantageously effected in that the capsule 6', after the pharmaceutical preparation 22 has been introduced is compressed radially, i.e. at its side walls, whereby the level of the pharmaceutical preparation 22 rises until no air remains inside the capsule 6'. At the aperture 18' a spherical surface of the liquid pharmaceutical preparation is formed as a consequence of the surface tension of the pharmaceutical preparation, which does not wet the defining portions of the aperture itself. At this stage, a drop of gelatine is applied in the region of the aperture 18' so as to cover the aperture 18'. The capsule 6' is then released from radial pressure so that the drop of gelatine applied over the aperture 18' is drawn inside the aperture and provides for a positive bond with the rim of the aperture, this providing in turn a reliable seal of the aperture 18' with the drop of gelatine solidifies.

Figure 3:
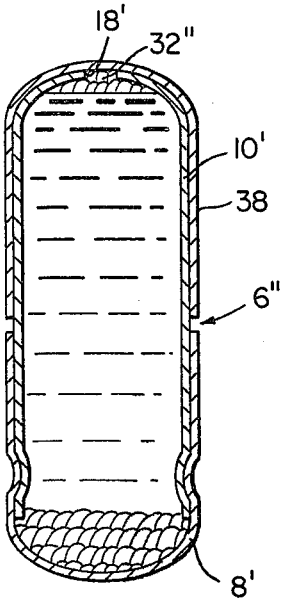

FIG. 3 shows an embodiment of a sealed capsule 6'' somewhat modified with respect to that illustrated in FIG. 2. The filling of the capsule proceeds identically to the filling of the capsule 6', according to FIG. 2, up to and including the filling step. Then the aperture 18'' in the body part 10' is closed by telescoping another cap 38 onto the body part 10' which cap 38 is provided at the inside of its closed end with a drop of gelatine 32''. This drop 32'' is pressed to a flat configuration when the further cap 38 is fitted over the body part 10' and closes the aperture 18' by its large-area contact with the inner side of the further cap 38, on the one hand, and on the other, with the outer side of the body part 10'. The further cap 38 provides the capsule 6'' additionally with greater stability. The capsule may in this case as well as advantageously somewhat compressed radially before telescoping the further cap 38.

Figure 4:
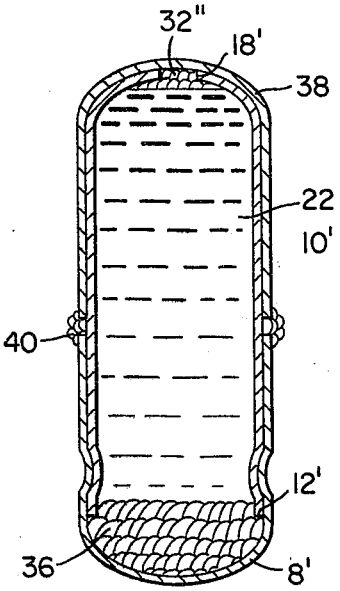

In the embodiment of the capsule illustrated in FIG. 4 the capsule illustrated in FIG. 3 is provided, between the open ends of the cap 8' and the further cap 38, with a band 40 sealing from outside so that the body part 10' is not in direct contact with the gastric juice when the capsule is administered.

Figure 5:
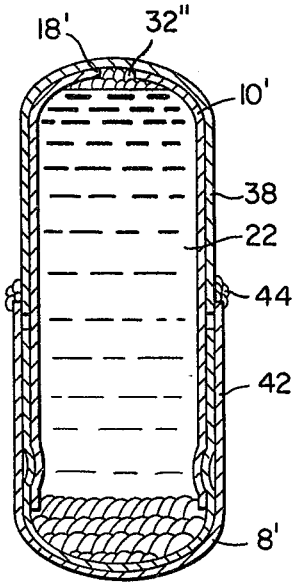

The embodiment illustrated in FIG. 5 differs from that illustrated in FIG. 3 in that an additional cap 42 is telescoped on the cap 8', which cap 42 is sealed by means of a band 44 with respect to the further cap 38. The capsule formed in this manner is exceptionally solid; also, as the caps 38 and 42 do not come into contact with the pharmaceutical preparation 22 but are merely telescoped on the parts provided with closed curved portions, the caps 38 and 41 need not be manufactured with great dimensional accuracy; the capsule can for instance be a delayed-release capsule if the caps 38 and 42 are made of an accordingly slowly dissolving material.

We claim:

1. A sealed capsule suitable for filling with a liquid or other viscous material, the capsule comprising a body part having a ridge or open end and a closed end, and a cap having an open end and a closed end wherein an aperture is formed in the closed end of the cap and being telescopically mounted on the body part, wherein the body part is filled with the liquid or other viscous material and the ridge of the body part received in the cap is sealed with respect to the adjacent area of the internal surface of the cap with a sealing composition which is inert with respect to and insoluble in the liquid or other viscous material.

2. The capsule as claimed in claim 1 wherein the cap is filled with the sealing composition.

3. The capsule as claimed in claim 1 wherein a plug comprising sealing composition is applied to and extends over said aperture.

4. The capsule as claimed in claim 1 or claim 2 wherein an aperture is formed in the closed end of the body part which aperture is sealed with sealing composition.

5. The capsule as claimed in claim 4 wherein a further cap is telescoped on the body part of the capsule filled with viscous material and sealing composition is contained in the area of the aperture between the closed end of the further cap and the body part.

6. The capsule as claimed in claim 5 wherein the area between the further cap and the cap closing the open end of the body part is sealed with a band.

7. The capsule as claimed in claim 5 wherein an additional cap is telescoped on the cap closing the open end of the body part, which additional cap is sealed with respect to the further cap by means of a band.

8. A method for the production of a sealed capsule formed of a body part having a ridge or open end region and a closed end region and a cap which has an open region and a closed end region and which is telescopically fitted on the body part, the body part being filled with a liquid or other viscous material, which method comprises filling the body part of the closed capsule with the liquid or other viscous material through an aperture in the capsule, and sealing the ridge of the body part received in the cap with respect to the adjacent area of the internal surface of the cap from inside with a pasty, solidifiable sealing composition which is inert with respect to and insoluble in the viscous material.

9. The method as claimed in claim 8 wherein the cap is filled with the sealing composition.

10. The method as claimed in claim 8 or claim 9 wherein the capsule is held in a verticle position with the cap uppermost is filled through an aperture in the closed end of the cap with the liquid or other viscous material to a level slightly below the ridge of the body part, after which through the aperture the space above the liquid or other viscous material is filled with the sealing composition.

11. The method as claimed in claim 10 wherein the aperture is formed in the verticle axis of the capsule, and the capsule is rotated about its verticle axis during filling of the sealing composition.

12. The method as claimed in claim 11 wherein the sealing composition is filled by extruding it from an orifice, and during filling the orifice is moved during extrusion from an area adjacent the ridge of the body part, after at least one revolution of the capsule, first radially inwardly towards the verticle axis of the capsule and then upwardly out of the aperture.

13. The method as claimed in claim 10 wherein a plug comprising sealing composition is applied to and extends over the aperture.

14. The method as claimed in claim 8 or claim 9 wherein the sealing composition is introduced before the liquid or other viscous material.

15. The method as claimed in claim 14 wherein the capsule is held in a verticle position with the body part uppermost is partly filled with the sealing composition to a level above the ridge of its body part and through an aperture in the closed end of the body part is completely filled with the liquid or other viscous material to a level below the aperture, and the aperture is sealed thereafter.

16. The method as claimed in claim 15 wherein the sealing composition is introduced through the aperture in the closed end of the body part.

17. The method as claimed in claim 15 wherein the capsule is radially compressed after the liquid or other viscous material has been introduced so that the material rises to a level directly below the aperture, sealing composition is then applied dropwise over the aperture to cover it and thereafter the capsule is decompressed.

18. The method as claimed in claim 15 wherein a further cap is telescoped on the body part of the capsule filled with the liquid or other viscous material after sealing composition has been provided on the inner side of the closed end of the further cap, or on the outer side of the body part in the area of the aperture.

19. The method as claimed in claim 8 wherein the sealing composition is introduced at an increased temperature corresponding to desired viscosity.

20. The method as claimed in claim 8 wherein the capsule comprises gelatine and the sealing composition comprises gelatine.

* * * * *